US006700988B2

(12) United States Patent
Wu

(10) Patent No.: US 6,700,988 B2
(45) Date of Patent: Mar. 2, 2004

(54) SPEAKER SPIDER WITH INTEGRAL LEAD WIRE ARRANGEMENT AND MANUFACTURING METHOD THEREOF

(76) Inventor: George K. Wu, 1357 Kuehner Dr., Simi Valley, CA (US) 93063

( * ) Notice: Subject to any disclaimer, the term of this patent is extended or adjusted under 35 U.S.C. 154(b) by 0 days.

(21) Appl. No.: 10/194,902

(22) Filed: Jul. 15, 2002

(65) Prior Publication Data

US 2004/0008860 A1 Jan. 15, 2004

(51) Int. Cl.[7] ..... H04R 25/00

(52) U.S. Cl. ..... 381/404; 181/171; 29/594

(58) Field of Search ..... 381/404, 410, 381/409, 403; 29/594, 609.1; 181/171, 172

(56) References Cited

U.S. PATENT DOCUMENTS 6,332,262 B1 * 12/2001 Sakamoto ..... 29/594

* cited by examiner

*Primary Examiner*—Sinh Tran
(74) *Attorney, Agent, or Firm*—Raymond Y. Chan; David and Raymond Patent Group

(57) ABSTRACT

A speaker spider arrangement includes a speaker spider and an integral lead wire arrangement which includes at least a pair of lead wires and an attachment member for attaching attachment portions of the lead wires on one side surface of the speaker spider so as to ensure the attachment portions of the lead wires being spacedly extended between an inner rim and an outer rim of the speaker spider and to integrate with the speaker spider to move simultaneously. Thereby, the integral lead wire arrangement provides the speaker spider with an enhanced durability, higher sound quality and improved safety, so as to enable a speaker to be manufactured by less steps in a lower cost while achieving a higher quality in comparison with the conventional speaker structure.

2 Claims, 4 Drawing Sheets

SPEAKER SPIDER WITH INTEGRAL LEAD WIRE ARRANGEMENT AND MANUFACTURING METHOD THEREOF

BACKGROUND OF THE PRESENT INVENTION

1. Field of Invention

The present inventions relates to a speaker, and more particularly to a speaker spider with integral lead wire arrangement that provides enhanced durability, higher sound quality and improved safety for a speaker with a minimum cost and manufacturing steps.

2. Description of Related Arts

Conventional speaker always has problems of instability and imperfect sound quality. These two major problems are inherent from the structural limitation of the conventional speaker.

Referring to FIG. 1 of the drawings, a conventional speaker 9 comprises a speaker frame 90, a cone 91, a speaker spider 92 and a voice coil 93. The cone 91, which is supported by the speaker frame 90 in an axially movable manner, has a connection opening 911 provided at a base portion 912 thereof and at least a pair through holes 913 provided at a predetermined position of the cone 91. The speaker spider 92 is co-axially connected to the base portion 912 of the cone 91. The voice coil 93 connected to the speaker spider 92 generally comprises two pairs of voice coil wires 931 extended towards the cone 91 by penetrating the through holes 913 of the cone 91 respectively. The speaker 9 also generally comprises two pairs of lead wires 94, each having a first and a second end, are adapted for connecting the voice coil 93 with an speaker terminal 95, wherein each of the first ends of the lead wires 94 penetrates the through holes 913 of the cone 91 and connects to the respective voice coil wire 931 of the voice coil 93 at the base portion 912 of the cone 91. Each of the second ends of the lead wires 94 is adapted for connecting to the speaker terminal 95 behind the cone 91. Therefore, lead wires 94 are suspending behind the cone 91 and several problems are induced from the wires connection between the voice coil 93 and the speaker terminal 95.

During the vibration of the cone 91 of the speaker, the lead wires 94 may overlap or touch with each other that may cause short circuit. It not only greatly degrades the quality of the speaker but also poses a risk of causing fire that adversely affects the utility safety of the speaker.

On the other hand, there will be relative pulling and pushing forces applied to the lead wires 94, stretching force occurred between the lead wires 94 and the cone 91, and relative pulling force formed between the lead wires 94 and the voice coil 93. Thus, the chance of losing or insecure contact between the lead wires 94 and other parts of the speaker is relatively great that may lead to sound instability. Or, in the worst case, the conventional speaker may be electrically disconnected when the connection between the wires breaks.

Since through holes 913 are necessarily provided on the cone 91 for the connection of wires, the cone surface is defected that generally lowers sound quality.

Furthermore, since the lead wires 94 are suspending behind the cone 91, there is relative force formed between the lead wires 94 and the speaker spider 92 such that the lead wires 94 greatly hinders the smooth vibration of the speaker spider 92 and adversely affects the sound quality.

SUMMARY OF THE PRESENT INVENTION

The main object of the present invention is to provide a speaker spider with integral lead wire arrangement which provides enhanced durability, higher sound quality and improved safety for a speaker.

Another object of the present invention is to provide a speaker spider with integral lead wire arrangement which enables a speaker to be manufactured by fewer steps in a lower cost while achieving a higher quality in comparison with the conventional speaker structure.

Another object of the present invention is to provide a speaker spider with integral lead wire arrangement, wherein the relative pulling and pushing force applied to the lead wires, the stretching force occurred between the lead wires and the cone, and/or the relative pulling force formed between the lead wires and the voice coil during vibration are eliminated.

Another object of the present invention is to provide a speaker spider with integral lead wire arrangement such that no suspending wire is required for connection to the voice coil and hence any possible unwanted contact or overlapping of the voice coil wires and the lead wires is eliminated.

Another object of the present invention is to provide a speaker spider with integral lead wire arrangement, wherein the cone surface is complete and no hole is required on the cone surface for connecting the voice coil wires of the vice coil and the lead wires to an speaker terminal.

Another object of the present invention is to provide a speaker spider with integral lead wire arrangement, wherein no relative movement between the speaker spider and the lead wires and the smooth vibration of the speaker spider will not be affected by any suspending lead wires behind the cone.

In order to accomplish the above objects, the present invention provides a speaker spider arrangement which comprises:

a speaker spider which has a central opening defining an inner rim for mounting on a voice coil of a speaker, a periphery outer rim for affixing to a speaker frame of the speaker, and a spring effect portion provided at a portion located between the inner rim and the outer rim to enable the inner rim to be moved axially up and down with respect to the outer rim when a driving force is applied to the inner rim and be retained to an original position after the driving force is released; and an integral lead wire arrangement which comprises:

at least a pair of lead wires each having a length longer than a distance between the inner rim and the outer rim of the speaker spider, wherein each of the lead wires has an inner end portion, an outer end portion and an attachment portion extended between the inner and the outer end portions, wherein the two attachment portions of the two lead wires are spacedly extended from the inner rim to the outer rim of speaker spider while the inner end portion and the outer end portion of each of the lead wires are outwardly extended from the inner rim and the outer rim of the speaker spider respectively for connection to voice coil wire of the voice coil and an speaker spider terminal of the speaker respectively, and means for attaching the attachment portions of the lead wires on one side surface of the speaker spider so as to ensure the attachment portions of the lead wires being spacedly extended between the inner rim and the outer rim of the speaker spider and to integrate with the speaker spider to move simultaneously.

DETAILED DESCRIPTION OF THE PREFERRED EMBODIMENT

Figure 1:
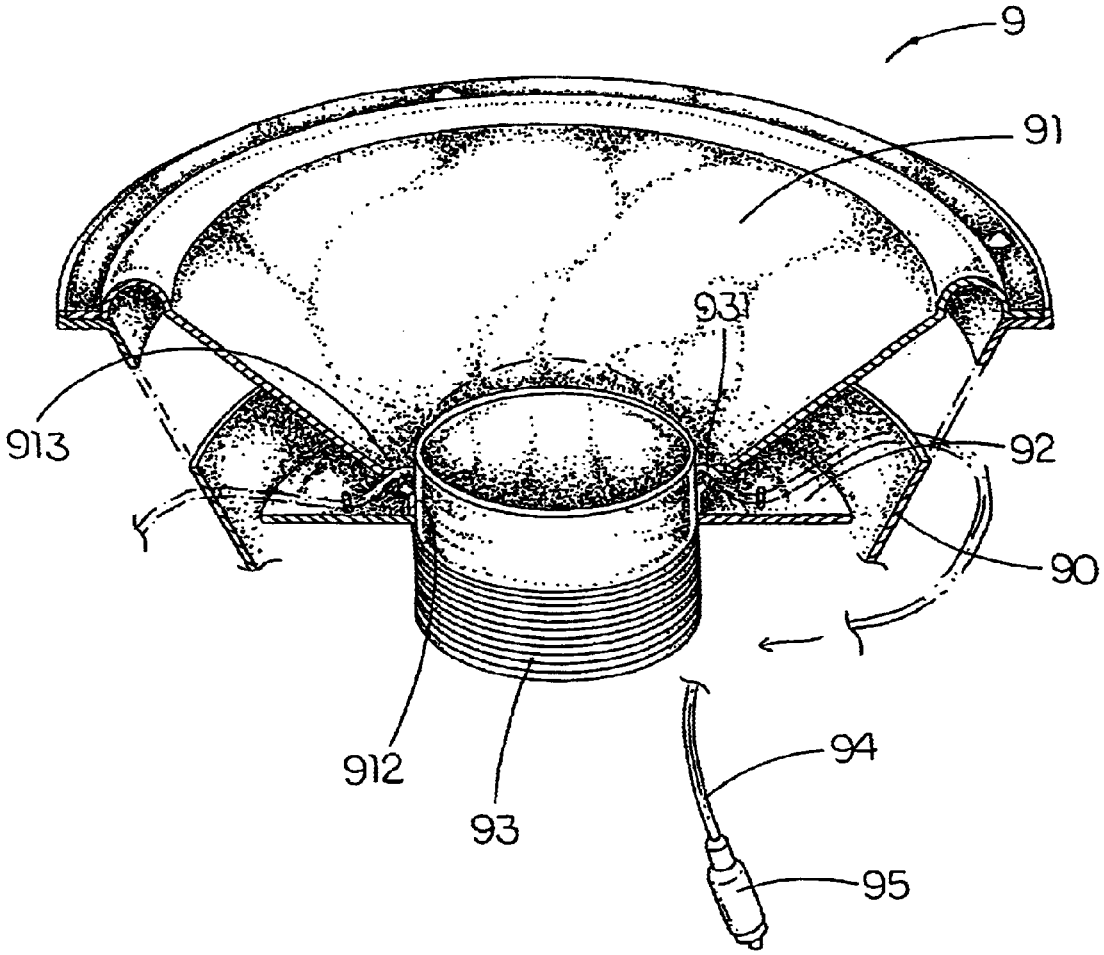
FIG.1 PRIOR ART
FIG. 1 is a sectional perspective view of a conventional speaker.
Figure 2:
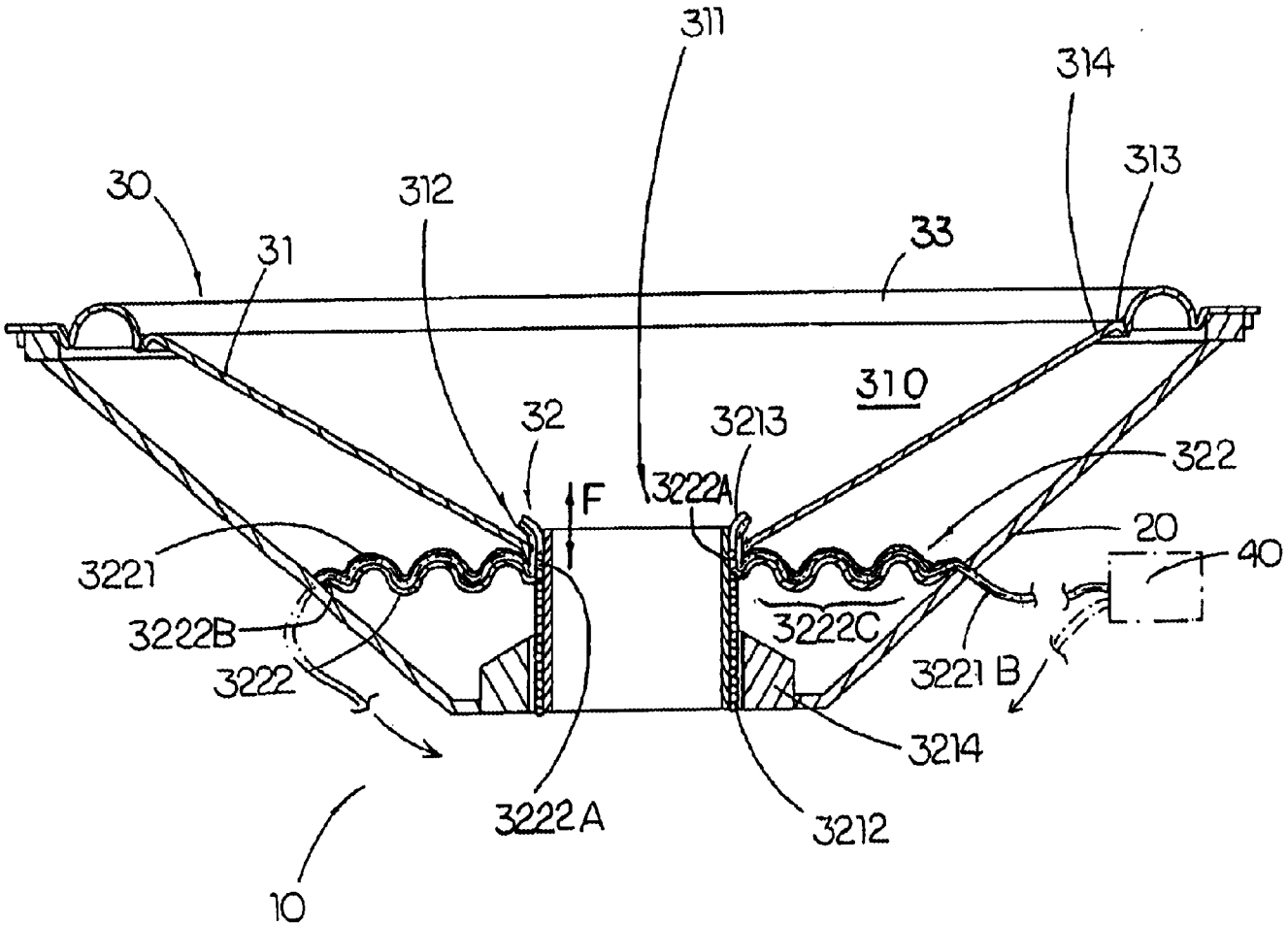
FIG. 2 is a sectional view of a speaker equipped with a speaker spider arrangement according to a preferred embodiment of the present invention.
Figure 3:
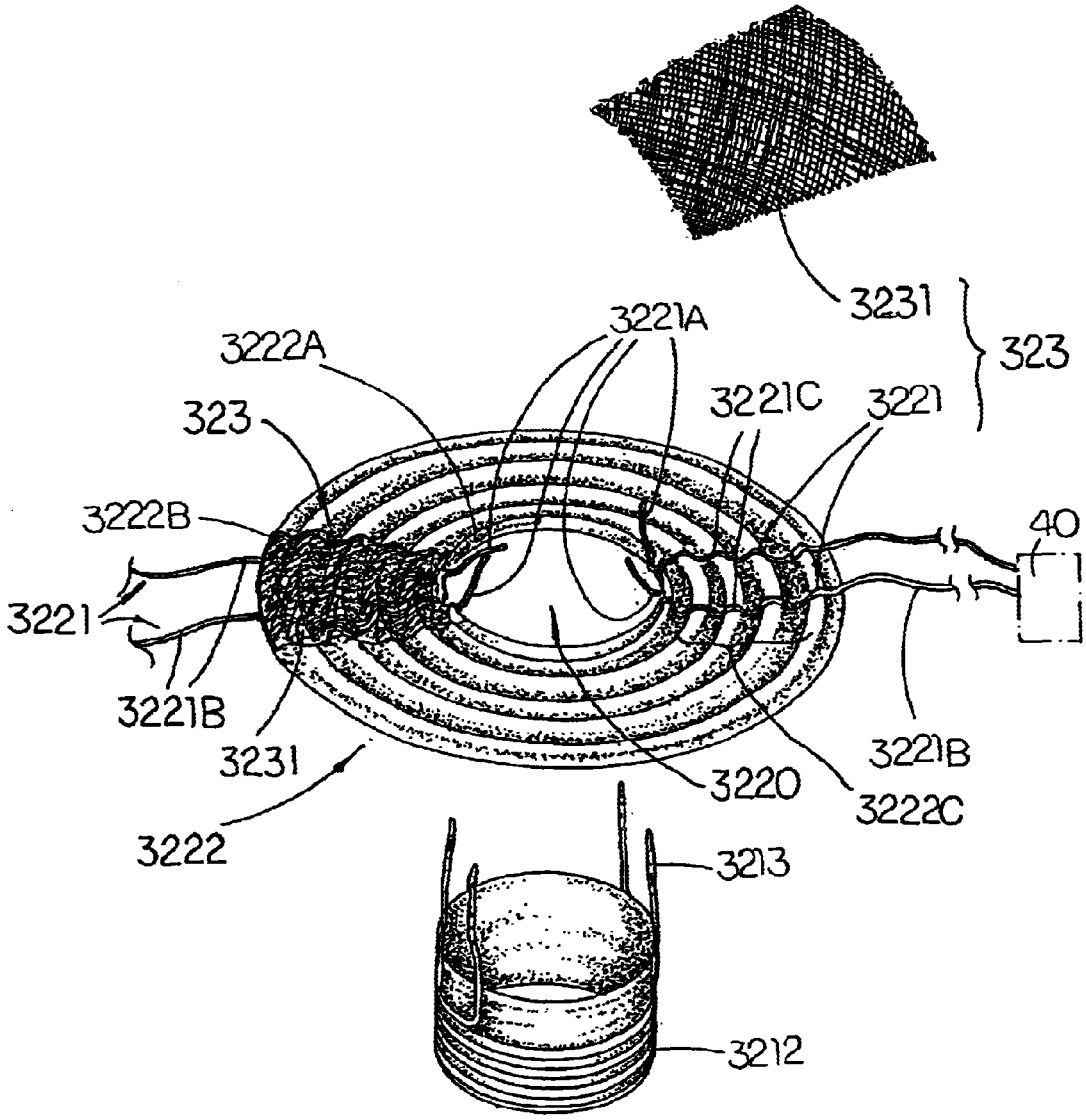
FIG. 3 is an exploded view illustrating the speaker spider and the voice coil according to the above preferred embodiment of the present invention.

Referring to FIGS. 2 and 3 of the drawings, a speaker 10 equipped with an integral lead wire arrangement is illustrated. The speaker 10 comprises a speaker frame 20 and an audio arrangement 30 supported by the speaker frame 20, wherein the audio arrangement 30 comprises a cone 31 and a secure wire connection system 32.

The cone 31 is supported by the speaker frame 20 in an axially movable manner. The cone 31 has a connection opening 311 provided at a base portion 312 thereof and a top rim 313 provided at a peripheral portion 314 thereof.

The secure connection system 32 comprises an induction device 321 and a speaker spider arrangement 322. The induction device 321 comprises a voice coil 3212 having at least a pair of voice coil wires 3213 extended up through the connection opening 311 of the cone 31 and a ring-shaped magnet base 3214 supporting by the speaker frame 20 and surrounding the voice coil 3212 for electromagnetic induction.

Referring to FIGS. 2 and 3, the speaker spider arrangement 322 comprises a speaker spider 3222 and an integral lead wire arrangement 323. The speaker spider 3222 has a central opening 3220 defining an inner rim 3222A for mounting on the voice coil 3212, a peripheral outer rim 3222B for affixing to the speaker frame 10, and a spring effect portion 3222C provided at a portion located between the inner rim 3222A and the outer rim 3222B, The spring effect portion 3222C has a wave shaped cross section to provide a spring effect for the speaker spider 3222 so as to enable the inner rim 3222A to be moved axially up an down with respect to the outer rim 3222B when a driving force F is force is applied to the inner rim 3222A and be retained to an original position after the driving force F is released. In other words, when the magnet base 3214 induces the voice coil 3212 to move up and down along an axis of the magnet base 3214 so as to vibrate the cone 31 to produce sound, the spring effect of the speaker spider 322 is adapted to retain the voice coil 3212 and the cone 31 back to its normal position with respect to the speaker frame 20 after each induction.

The integral lead wires arrangement 323 comprises at least a pair of lead wires 3221 corresponding to the pair of voice coil wires of the voice coil 3212, wherein each of the lead wires 3221 has a length longer than a distance between the inner rim 3222A and the outer rim 3222B of the speaker spider 3222. Each of the lead wires 3221 has an inner end portion 3221A, an outer end portion 3221B and an attachment portion 3221C extended between the inner and outer end portions 3221A, 3221B, wherein the attachment portions 3221C of the lead wires 3221 are spacedly extended from the inner rim 3222A to the outer rim 3222B of the speaker spider 3222 while the inner end portion 3221A and the outer end portion 3221B of each of the lead wires 3221 are outwardly extended from the inner rim 3222A and the outer rim 3222B of the speaker spider 3222 respectively for connection to a voice coil wire 3213 of the voice coil 3212 and an speaker terminal 40 of the speaker 10 respectively.

The integral lead wires arrangement 323 further comprises an attaching means 3231 for attaching the attachment portions 3221C of the lead wires 3221 on one side surface of the speaker spider 3222 so as to ensure the attachment portions 3221C of the lead wires 3221 being spacedly extended between the inner rim 3222A and the outer rim 3222B of the speaker spider 3222 and to integrate with the speaker spider 3222 to move simultaneously.

Figure 4:
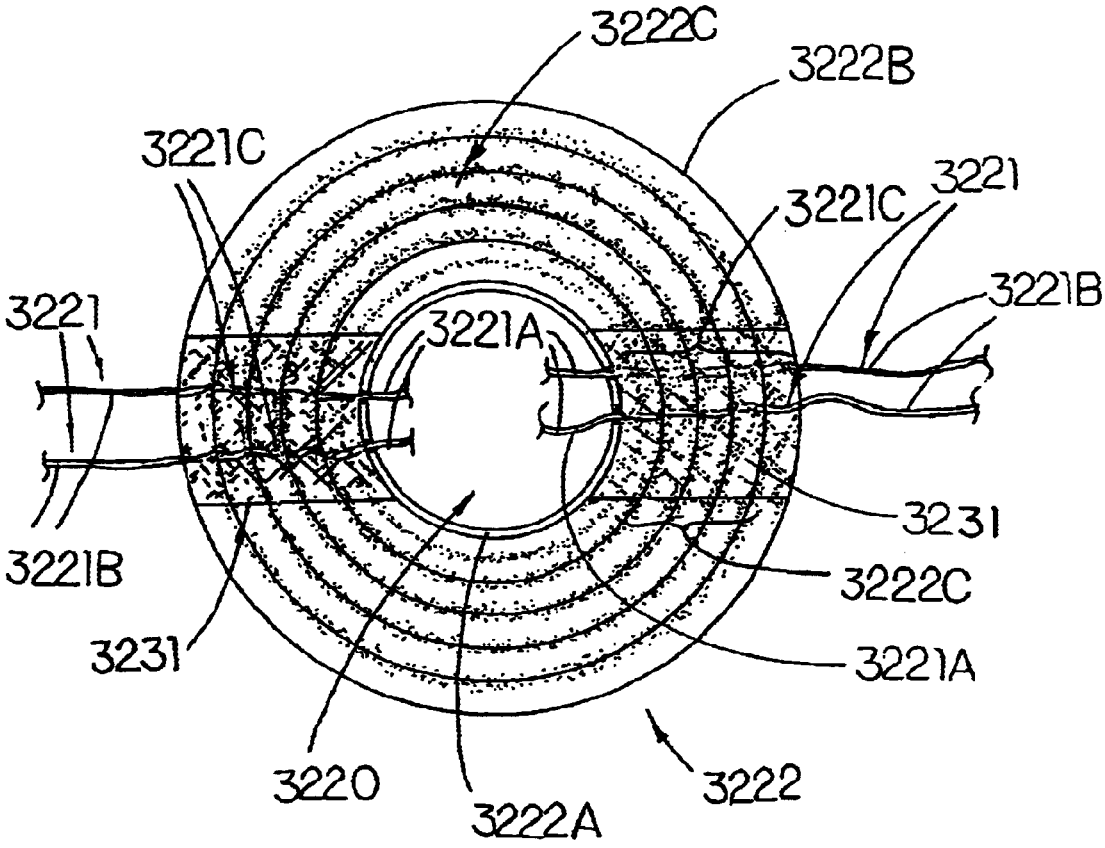
FIG. 4 is a top view of the speaker spider arrangement according to the above preferred embodiment of the present invention.

Referring to the preferred embodiment of the present invention, as shown in FIGS. 2, 3 and 4, two pairs of lead wires 3221 extended from two sides of the inner rims 3222A to two opposing sides of the outer rims 3222B respectively and also attached on the side surface of the speaker spider 3222 by the attachment means 3231. The attachment means 3231 is embodied as a piece of attachment member which is preferably made of a sheet like material having a length at least equal to a width of the attachment portion 3222C of the speaker spider 3222 and a width larger than the spaced interval between each pair of lead wires 3221 to be attached on the speaker spider 3222. The attachment member 3231 can be a piece of tape, cotton paper, plastic film, neoprene membrane, fabric, knitting cloth, or other similar sheet like material. Adhesive layer is applied between the attachment member 3231 and the side surface of the speaker spider 3222 so as to adhere the two lead wires 3221 on the side surface of the speaker spider 3222, as shown in FIGS. 2, 3 and 4.

Generally, the speaker spider 3222 is made from a piece of ring-shaped meshed fabric, having a central opening 3220, which is molded to have the wave formed spring effect portion 3222C by means of a press mold or a roll mold. Heat may be applied during the molding step. In order to reinforcing and strengthening the fiber material of the speaker spider 3222, the meshed fabric is soaked with a kind of volatilizing adhesive so as to coated two layers of volatilizing adhesive on two side surfaces thereof before molding.

To manufacture a speaker spider with integral lead wire arrangement, two elongated lead wires are adhered across one of the side surfaces of the ring-shaped meshed fabric coated with volatilizing adhesive in a parallelly spaced manner. Thereafter, the ring-shaped meshed fabric and the elongated lead wires are molded to form an integral speaker spider which is further dried until the volatilizing adhesive is volatilized. The two elongated lead wires are cut at the middle to form the two pairs of lead wires 3221 adhered on the side surface of speaker spider 3222.

Finally, to construct the integral lead wire arrangement 323, two attachment members 3231 are adhered to cover the two pairs of lead wires 3221 for protection and avoiding any unwanted movement of the lead wires 3221 with respect to the speaker spider 3222.

The integral lead wire arrangement 323 can also be constructed to an existing speaker spider 3222. The user may adhere the pair of lead wires 3221 in a parallelly spaced manner to a bottom surface of the attachment member 3231 while the inner end portion 3221A and the outer end portion 3221B of each of the lead wires 3221 are extended from an inner side and an outer side of the attachment member 3231 so as to form the lead wire arrangement 323. The adhesive layer is coated to the bottom surface of the attachment member 3231 so that the attachment member 3231 can be adhered on the side surface of the speaker spider 3222 while the attachment portion 3221C of each of the lead wires 3221 is adhered to extend radially from the inner rim 3222A to the outer rim 3222B in a wave manner along the curvature of the spring effect portion 3222C, so that the attachment portions 3221C of the lead wires 3221 are arranged in complete contact with the speaker spider 3222 so as to ensure the lead wires 3221 are moving simultaneously with the speaker spider 3222 to avoid any vibration, sliding movement and tearing force with each other. In other words, the lead wires 3221 are integrally connected to the speaker spider 3222 to form an integral body.

Since the lead wires 3221 of the speaker spider arrangement 322 is attached on the speaker spider 3222 to form an integral body such that when the speaker spider 3222 vibrates with respect to the induction device 321, the lead wires 3221 attached on the speaker spider 3222 having the outer rim 3222B affixed to the speaker frame 20 is adapted for simultaneous motion with the speaker spider 3222 and the relative pulling forces between the speaker spider 3222 and the lead wires 3221 is eliminated.

The inner end portions 3221A of the lead wires 3221 are upwardly extended from the connection opening 311 of the cone 31 and connected to the voice coil wires 3213 of the voice coil 3212 respectively, and the outer end portions 3221B of the lead wires 3221 are adapted for connecting the speaker spider arrangement 322 to a speaker terminal 40. Therefore the speaker spider 3222 and the voice coil 3212 are connected securely for coaxial simultaneous motion and the relative pulling force between the voice coil 3212 and the lead wires 3221 of the speaker spider arrangement 322 is avoided.

Alternatively, the integral lead wire arrangement 323 can be incorporated with a well-made speaker spider 3221, wherein each pair of lead wires 3221 are adhered to an attaching surface of the attachment member 3231 in a parallelly spaced manner to form the integral lead wire arrangement 323 while the inner end portions 3221A and the outer end portions 3221B are extended outwardly from an inner side edge and an outer side edge of the attachment member 3231 respectively. Then, the integral lead wire arrangement 323 is attached onto the speaker spider 3222 by adhering the attaching surface of the attachment member 3231 on the side surface of the speaker spider 3222 so as to attach the attachment portions 3221C of the lead wires to the side surface of the speaker spider 3222, while having the inner and outer end portions 3221A, 3221B of the lead wires 3221 are outwardly extended from the inner rim 3222A and the outer rim 3222B of the speaker spider 3222 respectively. In other words, the attachment portions 3221C of the lead wires 3221 are spacedly extended between the inner rim 3222A and the outer rim 3222B of the speaker spider 3222 so as to integrate with the speaker spider 3222 to move simultaneously.

As shown in FIG. 2, the cone 31 of the audio arrangement 30 further comprises a holding element 33 connected around the outer rim 313 of the cone 31 in such a manner that the cone 31 is capable of restoring to a predetermined position after any displacement and is capable of vibrating in corresponding to motion directed by the voice coil 3212 of the induction device 321 of the secure connection system 32.

Referring to FIGS. 2 and 3 of the drawings, the lead wires 3221 of the speaker spider arrangement 322 is connected to the voice coil wires 3213 of the voice coil 3212 in an interior portion of the cone 31 such that no through hole is required to drill on the cone 310 surface and the perfectly intact cone surface allows high quality sound production of the speaker 10. The speaker spider arrangement 322, maintain a secure electrical connection of the speaker 10 by connecting the voice coil wires 3213 of the voice coil 3212 to the inner end 3221A of the lead wires 3221 and by the use of the lead wires 3221 attached on the speaker spider 3222 to connect to the speaker terminal 40, such that the induction device 321 is securely connected to the speaker terminal 40.

As described above, the concentric waving surface of the spring effect portion 3222C of the speaker spider 3222 is arranged for providing effective vibration motion of the speaker spider 3222, wherein the attachment member 3231 is flexible and is capable of fittingly attaching the lead wires 3221 onto the speaker spider 3222 according to the concentric wave surface 3222*s* of the speaker spider 3222 such that the lead, wires 3221 are fittingly and securely attached on the speaker spider 3222 and any relative pulling force between the speaker spider 3222 and the lead wires 3221 is eliminated and smooth vibration of the speaker spider 3222 is possible.

Alternatively, it would be apparent to modified the meshed fabric made attachment member 3231 as shown in FIGS. 3 and 5 can be substituted by a tape or other similar member. Moreover, the attachment member 3231 can also be modified as affixing two pairs of tubular holders, extending between the inner rim 3222A and outer rim 3222B, on the side surface of the speaker spider 3222 so that the lead wires 3221 are capable of penetrating through the tubular holders respectively to hold the lead wires 3221 in position. Besides, the lead wires 3221 are able to be attached to either the top side surface of the speaker spider 3222 (as shown in drawings) or the bottom side surface of the speaker spider 3222.

In view of above, the speaker spider with integral lead wire arrangement substantially achieves the following distinctive features:

1. The integral lead wire arrangement provides the speaker spider an enhanced durability, higher sound quality and improved safety.

2. The integral lead wire arrangement enables a speaker to be manufactured by less steps in a lower cost while achieving a higher quality in comparison with the conventional speaker structure.

3. By equipping the integral lead wire arrangement in a speaker, the relative pulling and pushing force applied to the lead wires, the stretching force occurred between the lead wires and the cone, and/or the relative pulling force formed between the lead wires and the voice coil during vibration are eliminated.

4. The speaker spider equipped with integral lead wire arrangement requires no suspending wire for connection to the voice coil and hence any possible unwanted contact or overlapping of the voice coil wires and the lead wires is eliminated.

5. The cone surface of the speaker is complete and no hole is required on the cone surface for connecting the voice coil wires of the vice coil and the lead wires to an speaker terminal.

6. There is no relative movement between the speaker spider and the lead wires and thus, the smooth vibration of the speaker spider will not be affected by any suspending lead wires behind the cone.

What is claimed is:

1. A speaker spider arrangement, comprising:

a speaker spider which has a central opening defining an inner rim, a periphery outer rim, and a spring effect portion provided at a portion located between said inner rim and said outer rim to enable said inner rim to be moved axially up and down with respect to said outer rim when a driving force is applied to said inner rim and be retained to an original position after said driving force is released; and an integral lead wire arrangement which comprises:

at least a pair of lead wires each having a length longer than a distance between said inner rim and said outer rim of said speaker spider, wherein each of said lead wires has an inner end portion, an outer end portion and an attachment portion extended between said inner and outer end portions, wherein said two attachment portions of said two lead wires are spacedly extended between said inner rim to said outer rim of said speaker spider while said inner end portion and said outer end portion of each of said lead wires are outwardly extended from said inner rim and said outer rim of said speaker spider respectively, and means for attaching said attachment portions of said lead wires on one side surface of said speaker spider so as to ensure said attachment portions of said lead wires being spacedly extended between said inner rim and said outer rim of said speaker spider and to integrate with said speaker spider to move simultaneously; wherein said attachment means comprises at least a piece of attachment member, made of a sheet like material, having a length at least equal to a width of said attachment portion of said speaker spider and a width larger than a spaced interval between said pair of lead wires to be attached on said speaker spider, wherein an adhesive layer is applied between said attachment member and said side surface of said speaker spider so as to adhere said two lead wires on said side surface of said speaker spider.

2. A method of equipping an integral lead wire arrangement with a speaker spider having a central opening defining an inner rim, a periphery outer rim and a spring effect portion provided at a portion located between said inner rim and said outer rim to enable said inner rim to be moved axially up and down with respect to said outer rim when a driving force is applied to said inner rim and be retained to an original position after said driving force is released, wherein said method comprises the steps of:

adhering an attachment portion of each pair of lead wires to an attaching surface of an attachment member in a spaced manner while inner end portions and outer end portions of said lead wires are extended outwardly from an inner side edge and an outer side edge of said attachment member respectively to form an integral lead wire arrangement; and attaching said integral lead wire arrangement onto a side of said speaker spider by adhering said attaching surface of said attachment member on said side surface of said speaker spider so as to attach said attachment portions of said lead wires to said side surface of said speaker spider, while said inner and outer end portions of said lead wires are extended outwardly from said inner rim and said outer rim of said speaker spider respectively.

* * * * *